US006371026B1

(12) United States Patent
Ben-Zion et al.

(10) Patent No.: US 6,371,026 B1
(45) Date of Patent: Apr. 16, 2002

(54) APPARATUS AND METHOD FOR COLLECTING RESIDUAL MATERIAL DISPERSED DURING IMAGING

(75) Inventors: Roni Ben-Zion, Hod Hasharon; David Eshed, Kfar Sava; Yehuda Barnes Solomon, Rishon Lezion, all of (IL)

(73) Assignee: CreoScitex Corporation, Ltd., Herzlia (IL)

( * ) Notice: Subject to any disclaimer, the term of this patent is extended or adjusted under 35 U.S.C. 154(b) by 0 days.

(21) Appl. No.: 09/472,959

(22) Filed: Dec. 27, 1999

(30) Foreign Application Priority Data

Jan. 3, 1999 (IL) ..... 127904

(51) Int. Cl.[7] ..... B41F 35/00
(52) U.S. Cl. ..... 101/483; 101/416.1
(58) Field of Search ..... 101/483, 416.1, 101/425, 423, 424.1, 424.2; 347/225, 262–264

(56) References Cited

U.S. PATENT DOCUMENTS 1,378,278 A * 5/1921 Roberts ..... 101/424
5,574,493 A 11/1996 Sanger et al. ..... 347/262
5,592,879 A * 1/1997 Waizmann ..... 101/423
5,644,986 A * 7/1997 Gydesen ..... 101/425
6,097,417 A * 8/2000 Richardson et al. ..... 347/225

* cited by examiner

*Primary Examiner*—John S. Hilten
*Assistant Examiner*—Anthony H. Nguyen
(74) *Attorney, Agent, or Firm*—Eitan, Pearl, Latzer &Cohen-Zedek

(57) ABSTRACT

Disclosed are apparatus and methods for protecting an optical system from residual material that is scattered and dispersed during the imaging of printing plates and collecting same. The apparatus includes a housing with upper and lower chambers and surrounding at least a portion of the printing drum. The lower chamber is configured to be fitted to the optical system of the imager. A compressed air supply connects to the lower chamber and a suction device connects to the upper chamber for extracting the residual material. Air from the compressed air supply is moved through the lower chamber forming two air-streams, which are drawn into the upper chamber with the residual material of the imaging process.

20 Claims, 4 Drawing Sheets

FIG. 1 (PRIOR -ART)

APPARATUS AND METHOD FOR COLLECTING RESIDUAL MATERIAL DISPERSED DURING IMAGING

FIELD OF THE INVENTION

This present invention relates to an apparatus for collecting residual materials dispersed during the imaging of printing plates.

BACKGROUND OF THE INVENTION

Reference is made to FIG. 1, which schematically illustrates a conventional imaging system, referenced 10, in which a printing plate 12 is externally attached to a drum 14 by means of clamps 16.

The imaging system 10 further includes a laser system 15 comprising an optical system 18 for transmitting a laser beam, referenced 20. The drum 14 rotates as indicated by arrow 22 and the optical system 18 travels axially along the drum's longitudinal axis. The printing plate 12 may be digitally imaged, that is, information is transferred directly from a computer 11 to the printing plate 12. The laser beam 20, which is controlled by the computerized system 11, effects the exposure of the desired image on the plate.

The printing plate may be an IR sensitive printing member that generally includes an imaging layer comprising an infra-red radiation absorbing material, for absorbing infra red radiation to cause imaging. The imaging layer may consist of an emulsion containing pre-polymer coated onto the surface of the plate. The action of the laser beam hitting the plate causes the material to polymerize. Some unwanted particulate matter is also produced by decomposition in the surface coating and this material is deposited on the plate surface or scattered (indicated by arrows 24) on to the imaging system.

The infra-red radiation absorbing material may include, for example, a carbon loaded organic resinous layer of materials. The carbon may be in the form of graphite, amorphous carbon black, or similar while the organic resins may include binders for the carbon. The material deposited on the plate surface and scattered particles are generally circular of one micron diameter containing carbon.

The deposits of carbon based particles in the interior part of the imaging system can cause severe erosion and wear on the complex moving parts.

In addition, the scattered particles collect on the external face of a glass cover 26 used for protection of the optical system. These particles affect the performance of the laser beam, blocking the rays. In current use, the protective glass cover 26 requires cleaning on a daily basis. The scattered articles are also known to cause artifacts on the imaged plates.

SUMMARY OF THE INVENTION

It is an object of the present invention to provide apparatus for collecting residual material, which is scattered and dispersed during the imaging of the printing plate.

There is thus provided, in accordance with a preferred embodiment of the present invention, apparatus and a method for collecting residual material dispersed during the imaging of a printing member attached to a printing drum. The imaging system includes an optical system.

The apparatus provided, in accordance with a preferred embodiment of the present invention, includes a housing circumscribed to the shape of the printing drum, the housing having upper and lower chambers, the lower chamber being configured to be fitted to the optical system, at least one compressed air supply connected to the lower chamber and a suction device which communicates with the upper chamber for extracting the residual material. The air from the compressed air supply is expelled through the lower chamber and drawn into the upper chamber.

Additionally, the method provided, in accordance with a preferred embodiment of the present invention, includes the steps of:

- installing a housing onto the optical system proximate to the drum, the housing circumscribed to the shape of the printing drum, the housing having upper and lower chambers;
- connecting at least one compressed air supply to the lower chamber;
- expelling air at high velocity through the lower chamber;
- collecting the dispersed residual material; and
- extracting the dispersed residual material via the upper chamber.

Furthermore, in accordance with an embodiment of the invention, the lower chamber includes first and second apertures formed therein through which the compressed air is expelled. The housing is configured so that the expelled air collects the dispersed residual material proximate the housing and the drum.

Furthermore, in accordance with an embodiment of the invention, the first aperture includes an orifice formed within the front face of the lower chamber, the center of the orifice being coincident with the optical axis of the optical system. The lower chamber further includes an annular air cell formed therein, the annular air cell being connected to the compressed air supply. The air cell includes a convergent conic space, the conic space converging towards the orifice.

Furthermore, in accordance with an embodiment of the invention, the second aperture includes a gap formed proximate the bottom face of the lower chamber, the gap being connected to the compressed air supply.

In addition, in accordance with an embodiment of the invention, the bottom face of the lower chamber is configured to have a generally concave shape. The lower chamber further includes a generally circular channel formed therein, the channel being connected to the at least one compressed air supply.

Furthermore, in accordance with an embodiment of the invention, the upper chamber includes a funnel shaped element connected to the upper chamber, the funnel shaped element diverging away from the upper chamber.

The upper chamber further includes a dividing element configured to divide the upper chamber so as to form a second orifice between the dividing element and the top of the lower chamber, proximate to the junction between upper chamber and lower chamber. The dividing element is configured so that the continuation of a central axial line between the dividing element and the top face of the lower chamber through the second orifice intercepts the printing drum at the point of imaging. The dividing element is configured to have a generally concave shape. The shape is similar to the bottom face of the lower chamber.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1:
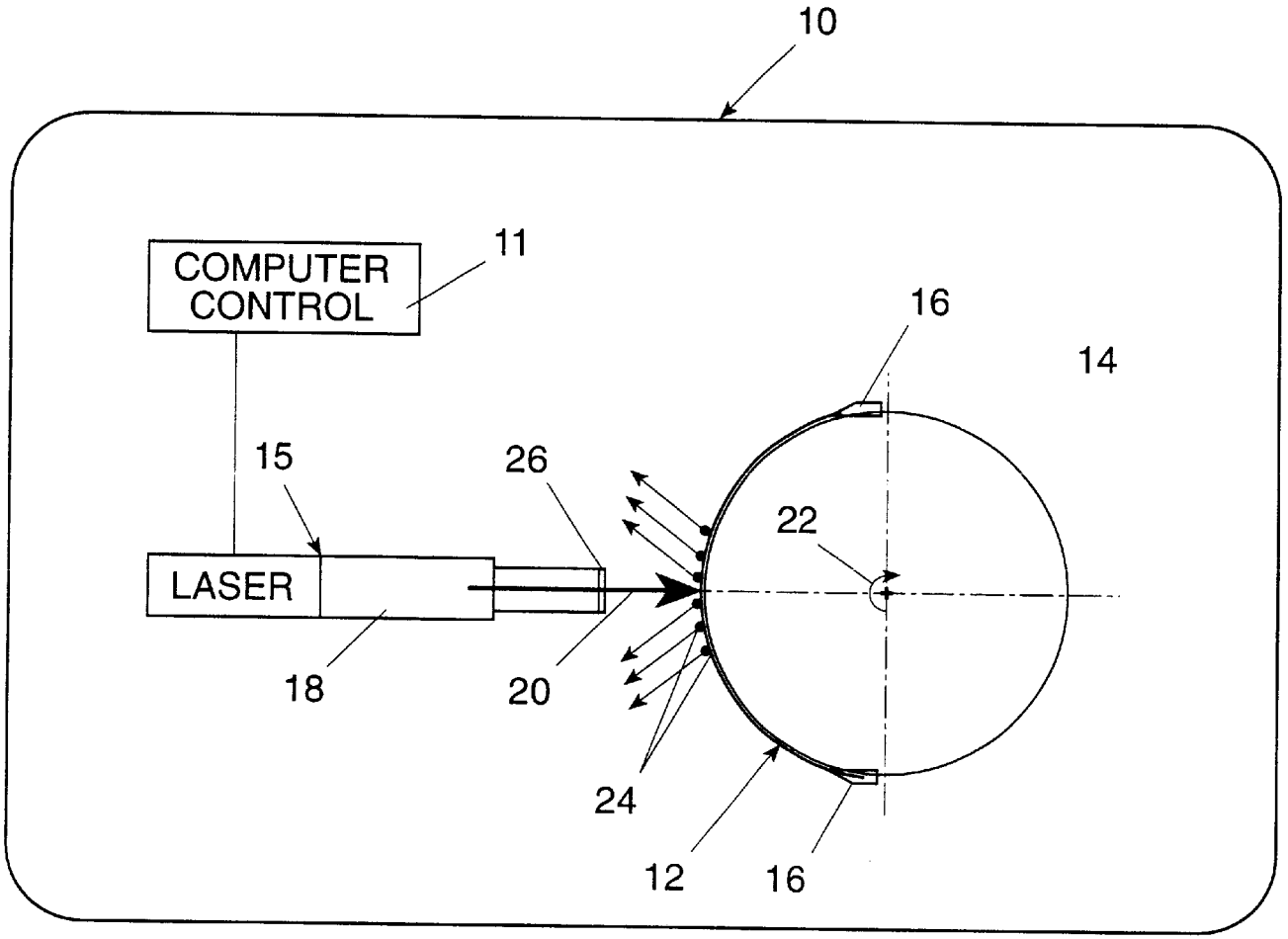
FIG. 1 Is schematic illustration of a prior art printing system.
Figure 2:
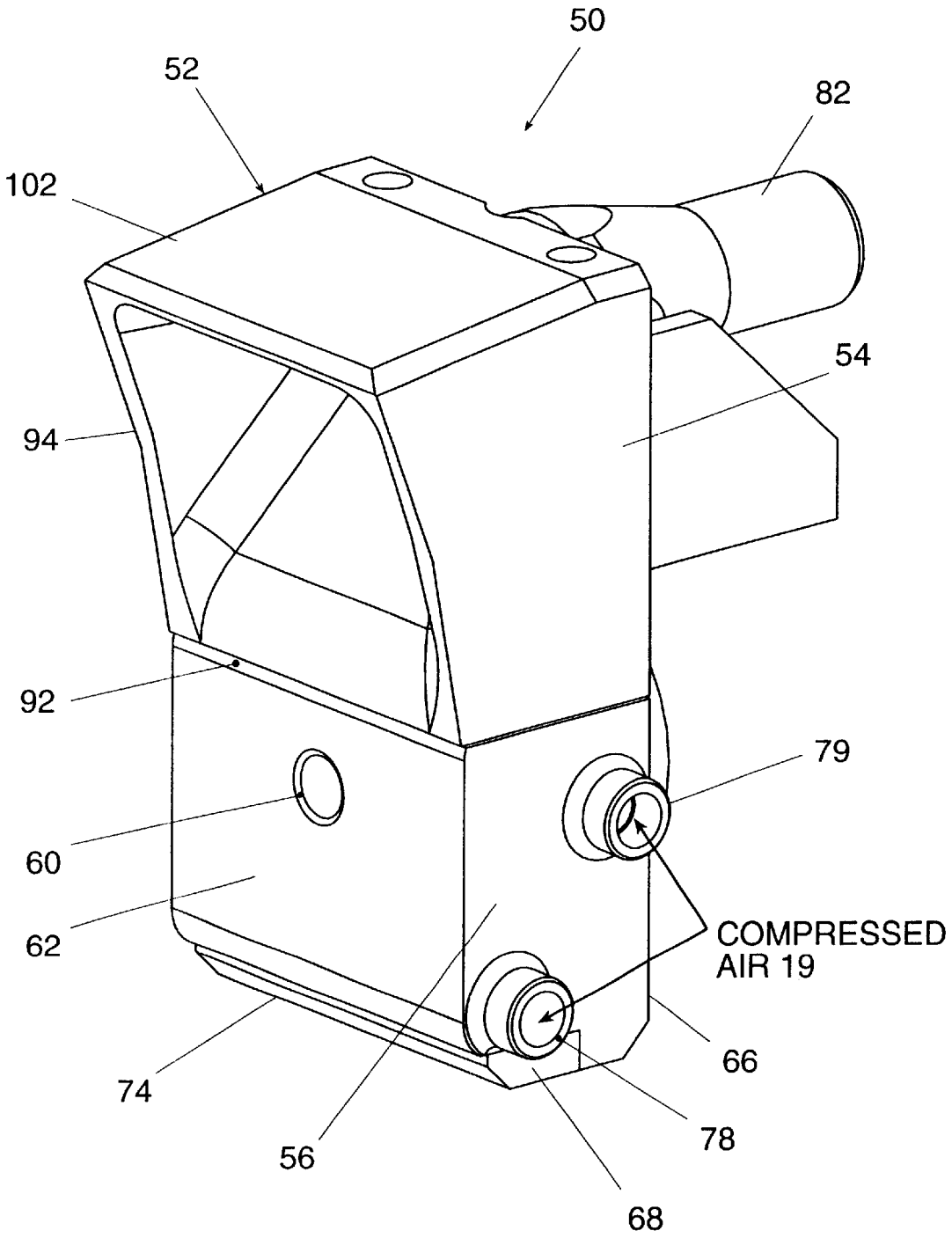
FIG. 2 is an isometric illustration of a collector for residual material, constructed and operative in accordance with a preferred embodiment of the present invention.
Figure 3A:
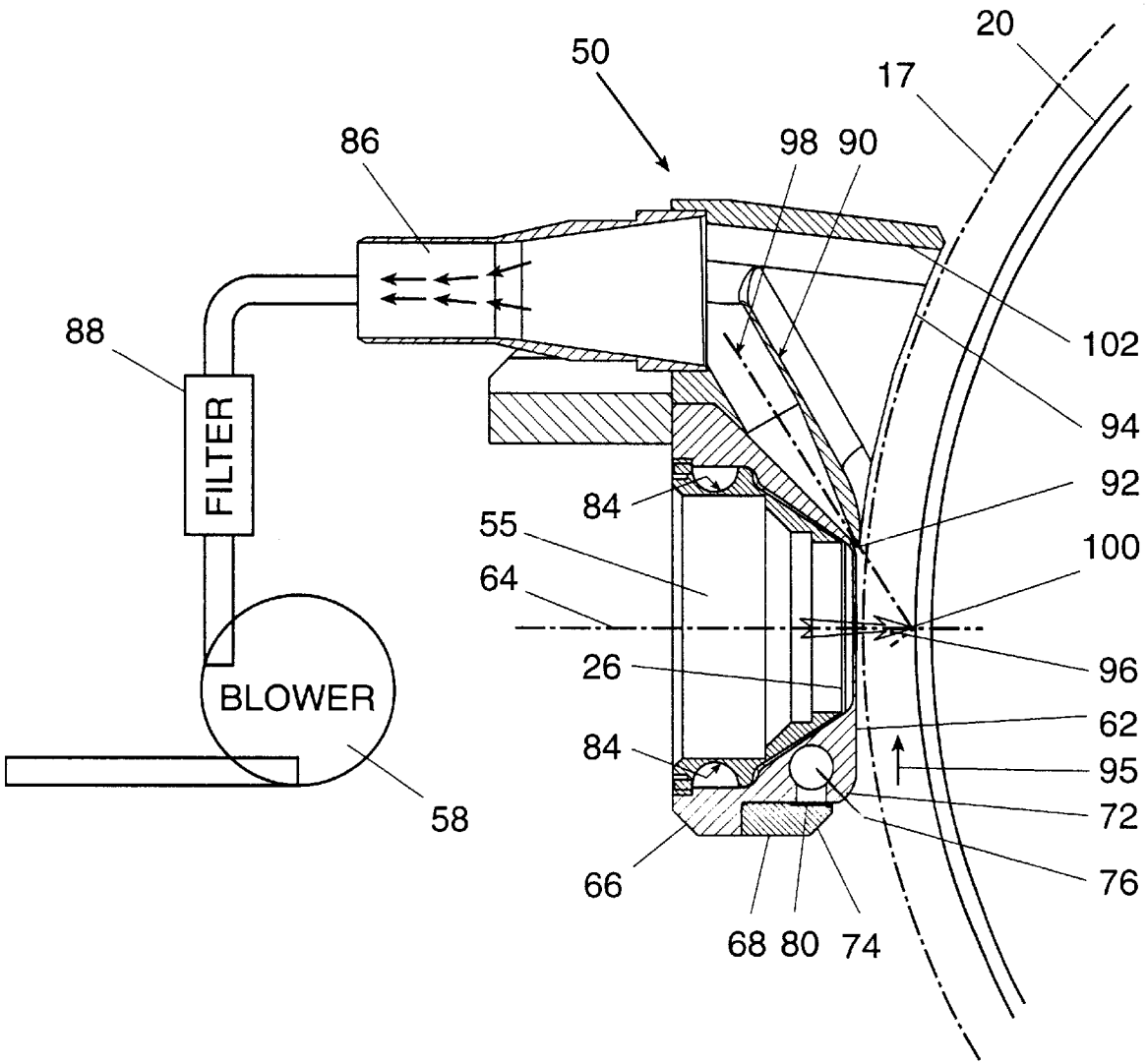
FIG. 3A is a partially sectional, side elevational view of the residual material collector of FIG. 2.
Figure 3B:
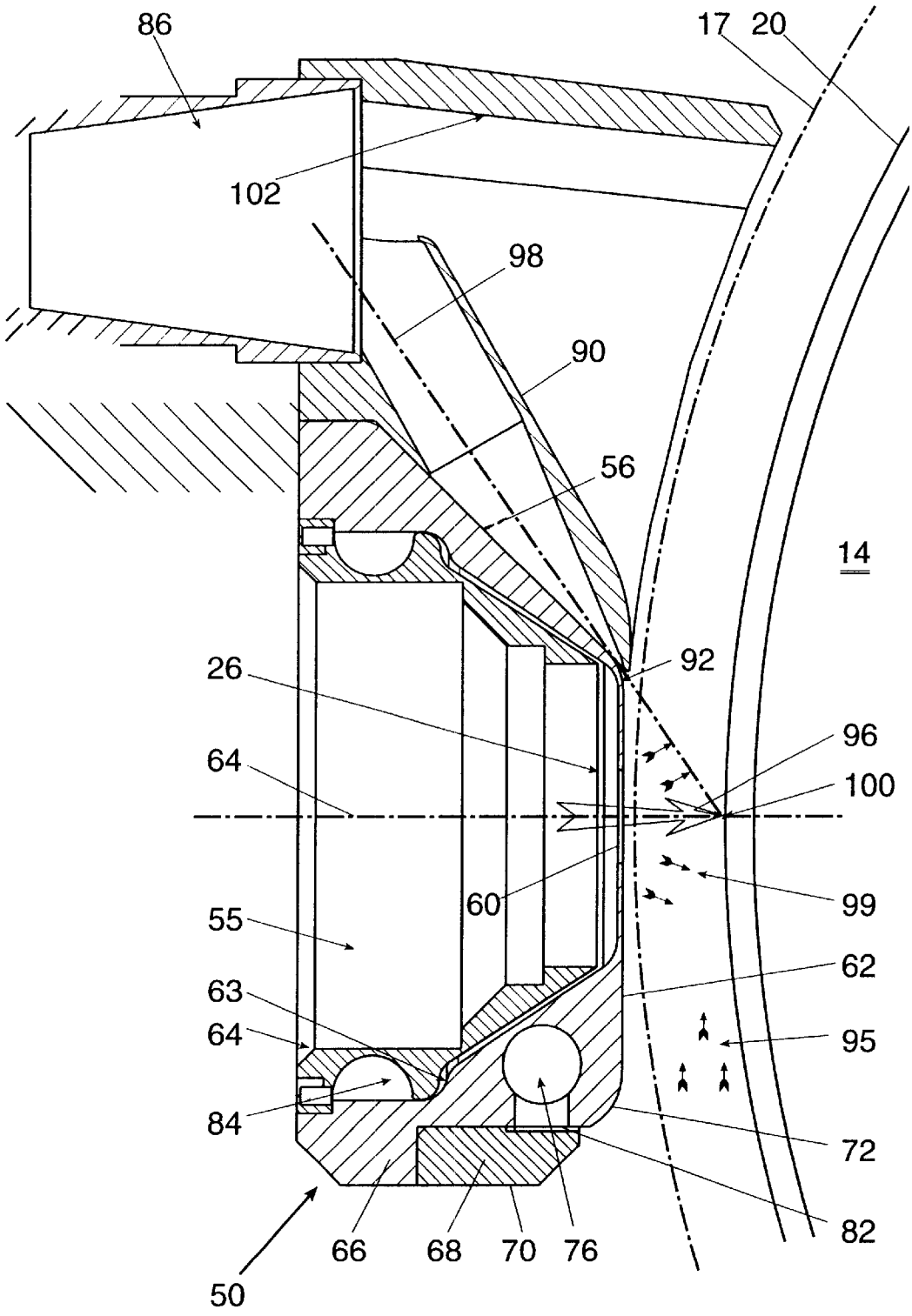
FIG. 3B is an enlarged section of FIG. 3A showing the interface of the collector and the imaging drum.

Reference is now made to FIGS. 2, 3A and 3B. FIG. 2 is an isometric illustration of a collector for residual material, generally designated 50, constructed and operative in accordance with a preferred embodiment of the present invention. FIG. 3A is a partially sectional, side elevational view of the residual material collector 50 and FIG. 3B is an enlarged section showing the interface of the collector 50 and the imaging drum 14.

Collector 50 is configured so as to be installed by any suitable means on to the front end 55 of the optical system 18 which is part of an imaging system (not shown). Details of the imaging system, which may be any system known in the art, will not be further described.

Collector 50 comprises a housing 52, which is circumscribed to the shape of the drum 14, the housing 52 having upper and lower chambers, referenced 54 and 56, respectively. Lower chamber 56 is configured to accept the lens (not shown in FIGS. 3A and 3B) and glass cover 26 of the optical system 55. Upper chamber 54 is connected to a suction/vacuum device 58 for extracting any residual material which may be deposited or scattered during imaging.

Collector 50 is configured to take advantage of the Coanda effect, explained in "*Fluid Dynamics for Physics*", pages 73–77, by T. E. Faber, published by Cambridge University Press. Compressed air is forced through and out of the lower chamber 56 of collector 50 so that the expelled air travels close to the external face of the collector and the external surface of the drum 14 and plate 20 into the upper chamber 54 for collection via the suction/vacuum device 58. During imaging, the collector 50 is placed in close proximity to the drum 14 so as to ensure that, owing to the Coanda effect, any deposited or scattered material is sucked into the upper chamber 54. The exact distance between collector 50 and drum 14 is determined by the dimensions of the clamps 16 attached to the drum for clamping the printing plate in position. In the example illustrated, the limiting factor imposed by the clamps is indicated by line 17 in FIGS. 3A and 3B.

An aperture 60 is formed within the front face 62 of lower chamber 56, the center of the aperture 60 lying along the optical axis 64 of the optical system 55. The lower chamber 56 comprises a first element 66 and a second generally rectangular element 68 integrally attached along two sides to the first element 66 along the bottom edge 70 of lower chamber 56.

The bottom corner 72 of front face 62 (of lower chamber 56) has a generally concave shape. The front face 74 of second element 68 is beveled and indented below the bottom corner 72 of front face 62. A generally circular channel 76 is formed within the first element 66, the channel 76 being connected to a coupling component 78 on one side of first element 66. Coupling component 78 is connectable to a compressed air supply 19. The top face 80 of second element 68 is chamfered (where the top face meets the channel 76) so as to leave an air gap 82 between the top face 80 of second element 68 and the bottom corner 72 of front face 62.

An annular air cell 84 is formed within the first element 66 and part 64, and is connected to compressed air supply 19 by conduit 79 branched from supply 19. Air outlet from cell 84 towards opening 60 is formed by an annular space 63, which converges conically (indicated by annular conic space 63). The annular air cell 84, which connects the annular space 63 to the air inlet, is relatively large (with respect to annular conic space 63) so that the resulting air flow through spacing 63 will be uniform.

Upper chamber 54 is connected to a suction/vacuum device via a funnel shaped connecting element 86, which diverges away from upper chamber 54. Preferably, a filter unit 88 is installed upstream of suction/vacuum device 58.

Upper chamber 54 comprises a dividing wall 90 which is configured to divide the upper chamber 54 so that an orifice 92 is formed in the front face 94 of the upper chamber 54, proximate to the junction between upper chamber 54 and lower chamber 56. The wall 90 is curved (similar to the curvature of bottom corner 72 of lower chamber 56). Wall 90 is configured so that a continuation of the axial line, indicated by dashed line 98, via orifice 92, intercepts the imaging drum at the point (referenced by 100) being imaged, that is, it coincides with the laser beam 20 hitting the printing plate. Axial line 98 is the central axis between dividing wall 90 and the top face of lower chamber 56.

As will be explained below, the dividing wall 90 diverts the flow of air entering via orifice 92 towards the funnel element 86. The lower chamber 56 is curved at the junction (similar to the bottom corner 72).

Operation

The operation of the collector 50 may be described as follows:

In an exemplar illustration, the distance between the collector 50 and the printing plate 12 on the drum is about 11 mm, so as leave sufficient space for fastening the plate to the drum.

Compressed air 19 is fed via coupling component 78 (FIG. 2) to channel 76 in first element 66 (of lower chamber 56). The air is expelled through air gap 82 (between the top face 80 of second element 68 and the bottom corner 72 of front face 62). The flow of air moves upwards, normal to the laser beam, referenced 96, (of optical system 55) taking advantage of the "Coanda effect" and creating a high speed wall (or curtain) of air (as indicated by arrows 95). The air collects any residual particles in the vicinity pulling them towards the center of the air wall 95 and propelling them upward to the intake of upper chamber 54. The flow of air "curves" in the direction of orifice 92 helped by curvature of lower chamber 56 at its juncture with orifice 92.

The size of orifice 92 is determined so that the flow of air is forced to continue in this direction. The second source of compressed air supply 79 is fed to air conduit 84. The compressed air streams through the air conduit 84 (formed within the first element 66) and is directed to the aperture 60 (flow line arrows 99 in FIG. 3B). The convergent conic annular space 63 tends to accelerate the stream of air. The air leaving aperture 60 effectively acts as a "shield" to the glass 26 protecting the optical system from being hit by residual particles.

The inner face 102 of upper chamber 54 and the curvature of dividing wall 90 cause the air flow (containing particles) entering upper chamber 54 to be smoothly directed to the opening of funnel element 86.

In addition, the inner faces of upper chamber 54 are preferably coated with a resistant material such as Teflon™ to reduce the effect of friction from the particles hitting it.

All the air carrying particles of dispersed material is funneled through funnel element 86 and via filter 88 to suction/vacuum device 58 which extracts the ablated material.

It will be appreciated that the present invention is not limited by what has been described hereinabove and that numerous modifications, all of which fall within the scope of the present invention, exist. Rather the scope of the invention is defined by the claims, which follow:

What is claimed is:

1. Apparatus for collecting residual material dispersed during the imaging of a printing member attached to a printing drum, the imaging system having an optical system, the apparatus comprising:

a housing surrounding at least a portion of the drum, the housing having upper and lower chambers, the lower chamber being configured to be fitted to the optical system and having a first air cell connected to an orifice formed in said housing near the optical system and a second air cell connected to a gap opening towards said drum;

at least one inlet for compressed air connected to the lower chamber; and a suction device which communicates with the upper chamber for extracting the residual material.

2. The apparatus according to claim 1 wherein the orifice is formed within the front face of the lower chamber, the central axis of the orifice being coincident with the optical axis of the optical system.

3. The apparatus according to claim 1, wherein the first air cell has a convergent conic space, the conic space converging towards the orifice.

4. The apparatus according to claim 1, wherein the gap is formed proximate a bottom front face of the lower chamber.

5. The apparatus according to claim 1, wherein a bottom corner of the front face of the lower chamber is configured to have a generally concave shape.

6. The apparatus according to any of claims 1–5, wherein the upper chamber is connected to a funnel shaped element which diverges away from the upper chamber.

7. The apparatus according to claim 6, wherein the upper chamber further comprises a dividing element configured to divide the upper chamber so as to form an orifice between the dividing element and the top of the lower chamber, proximate to the junction between upper chamber and lower chamber.

8. The apparatus according to claim 7, wherein the dividing element is configured so that the continuation of a central axial line between the dividing element and the top face of the lower chamber through the orifice intercepts the printing drum at the point of imaging.

9. The apparatus according to claim 7, wherein the dividing element is configured to have a generally concave shape.

10. The apparatus according to claim 7, wherein the upper front face of said lower chamber is configured to have a concave shape at its junction with said dividing element similar to the bottom corner of the front face of the lower chamber.

11. A method for collecting residual material dispersed during the imaging of a printing member attached to a printing drum, the imaging system having an optical system, the method comprising the steps of:

having a housing around the optical system proximate to the drum, the housing surrounding at least a portion of the drum, the housing having upper and lower chambers;

moving a first stream of compressed air near said optical system to generally prevent said dispersed residual material from hitting said optical system and a second stream of compressed air passed said drum to collect the dispersed residual material; and extracting the dispersed residual material via the upper chamber.

12. A method according to claim 11, wherein said step of extracting comprises the step of diverging said second stream towards the upper chamber.

13. Apparatus for collecting residual material dispersed during the imaging of a printing member attached to a printing drum, the imaging system having an optical system, the apparatus comprising:

a housing surrounding at least a portion of the drum and being configured to be fitted to the optical system;

means for moving compressed air through a gap between the apparatus and the drum and collecting the dispersed residual material;

means for generally preventing the dispersed residual material from hitting the optical system; and means for removing the dispersed residual material.

14. The apparatus according to claim 13 wherein the means for moving compressed air through the a gap between the apparatus and the drum comprises an air cell connected to an inlet for compressed air and to a gap opening towards said drum.

15. The apparatus according to claim 13 wherein the means for generally preventing the dispersed residual material from hitting the optical system comprises an air cell connected to an orifice formed in said housing near the optical system connected to an inlet for compressed air.

16. The apparatus according to claim 15 wherein the housing has an upper and a lower chamber, and wherein the orifice is formed within the front face of the lower chamber, the central axis of the orifice being coincident with the optical axis of the optical system.

17. The apparatus according to claim 13 wherein the housing has an upper and a lower chamber, and wherein the means for removing comprises a dividing element configured to divide the upper chamber so as to form an orifice between the dividing element and the top of the lower chamber, proximate to the junction between upper chamber and lower chamber and a suction device which communicates with the upper chamber.

18. The apparatus according to claim 13 wherein the means for generally preventing the dispersed residual material from hitting the optical system comprises a convergent conic space.

19. The apparatus according to claim 13 wherein the housing has an upper and a lower chamber, and wherein the means for moving compressed air through a gap between the apparatus and the drum and collecting the dispersed residual material comprises a gap formed proximate a bottom front face of the lower chamber.

20. The apparatus according to claim 13 wherein the housing has an upper and a lower chamber, and wherein a bottom corner of a front face of the lower chamber is configured to have a generally concave shape.

* * * * *